United States Patent [19]

Dixon et al.

[11] 4,007,799

[45] Feb. 15, 1977

[54] RAISE DRILL WITH REPLACEABLE STEM

[75] Inventors: Robert L. Dixon, Brea; Robert E. Allison, Whittier, both of Calif.

[73] Assignee: Smith International, Inc., Irvine, Calif.

[22] Filed: July 7, 1975

[21] Appl. No.: 593,839

[52] U.S. Cl. ..... 175/340; 175/53; 175/320; 175/364; 175/375

[51] Int. Cl.[2] ..... E21B 9/08

[58] Field of Search ..... 175/53, 339, 340, 334, 175/335, 357, 374, 344, 320

[56] References Cited

UNITED STATES PATENTS

| | | | |
|---|---|---|---|
| 2,090,356 | 8/1937 | Reed | 175/340 |
| 2,239,461 | 4/1941 | Mann | 175/385 |
| 3,092,190 | 6/1963 | Guere | 175/393 X |
| 3,384,191 | 5/1968 | Schmacher, Jr. et al. | 175/340 |
| 3,675,729 | 7/1972 | Neilson | 175/53 X |
| 3,866,698 | 2/1975 | Stanley | 175/53 |
| 3,902,562 | 9/1975 | Pessier et al. | 175/53 |
| 3,917,009 | 11/1975 | Dyer et al. | 175/53 |
| 3,920,089 | 11/1975 | Mitchell | 175/53 |

*Primary Examiner*—Ernest R. Purser
*Assistant Examiner*—Richard E. Favreau
*Attorney, Agent, or Firm*—Christie, Parker & Hale

[57] ABSTRACT

A raise type of earth boring drill in which the cutter assembly is detachably secured to the drive stem to permit replacement of the stem. The stem slidably engages a central opening in the cutter assembly, the cutter assembly engaging a shoulder on the stem which carries axial loads in the drill. The cutter assembly is detachably anchored by a plurality of bolts to a torque plate attached to the end of the stem for transmitting torque load to the cutter assembly, the bolts clamping the cutter assembly against the shoulder.

18 Claims, 2 Drawing Figures

RAISE DRILL WITH REPLACEABLE STEM

FIELD OF THE INVENTION

This invention relates to raise-type earth boring drills, and more particularly to a drill in which the drive stem is removably attached to the cutter assembly.

BACKGROUND OF THE INVENTION

It is well known in the mining art to utilize a raise type of earth boring drill to form vertical shafts between mining tunnels at different levels. One such type of raise drill is described, for example, in U.S. Pat. No. 3,675,729. The tool is used by first drilling a small pilot hole between the two levels. A drill string is then lowered through the pilot hole from rotary drive equipment at the upper level and a raise drill tool is attached at the lower level to the drill string. The drill is then drawn upwardly while simultaneously being rotated by the drill string, the drill reaming out the hole to the desired diameter. In an exemplary embodiment the pilot hole may be 11 inches in diameter and the raise drill reams out a hole 6 feet in diameter.

The stem of the raise drill, which is slightly smaller in diameter than the pilot hole, acts as a guide for the raise drill. However, the stem is subjected to considerable wear due to abrasive contact with the surrounding earth formation and, at the same time, is subjected to considerable stress both of tension due to the lifting force imparted to the drill, twisting due to the torque applied to the drill, and bending due to unequal loading around the circumference of the drill. Usually a protective layer of hard facing is applied to the drill stem to give added protection against the abrasive action of the surrounding earth materials.

Although it is common to provide such drills with replaceable rotary cutters, generally the stems have not been made readily replaceable. Thus when the stem becomes worn or fails in operation, replacement of the drill tool is required. While the replacement of the stem portion of a raise drill has heretofore been proposed, as in U.S. Pat. Nos. 3,659,659 and 3,750,767, such known designs have relied on welded or threaded joints to transfer the torque and longitudinal forces from the stem to the cutter assembly. The raise drill in U.S. Pat. No. 3,750,767 has a steep taper between the stem and cutter assembly. Special cutting, pulling, or torquing tools are then required to disassemble and remove the stem from the cutter assembly, which tools are not always readily available in the mining tunnels where the equipment is being used. Furthermore such known drills do not provide any means for directing cooling or lubricating fluids through the center of the stem to the cutters in the cutter assembly, which presents a unique problem where the stem is to be made separable from the cutter assembly.

SUMMARY OF THE INVENTION

The present invention is directed to an improved raise drill in which the stem is easily removed from the cutter assembly to provide simple replacement in the field. Separate connections between the cutter assembly and the stem are provided for respectively transferring the principal axial load and the principal torque load between the stem and the cutter assenbly. Disassembly is effected by removal of several standard bolts which, while locking the cutter assembly and the stem together, do not in themselves transfer any of the axial load between the stem and the cutter assembly and little, if any, of the torque load. A simple fluid coupling between the cutter assembly and the drive stem connects a central passage in the stem to a fluid manifold in the cutter assembly from which coolant fluid under pressure can be applied to the individual cutter elements.

This is accomplished, in brief, by providing a raise drill comprising a stem having means at its upper end for connection to a drill string. A torque plate is rigidly secured to the lower end of the stem. A separate cutter assembly includes a frame plate having a central hole through which the upper end of the stem is inserted. The stem has an upwardly facing shoulder which engages the frame plate around the central hole for transferring the axial drilling load between the frame plate and the stem. A plurality of rotary cutters are mounted on the frame plate around the central hole. The cutter assembly also includes a flange plate which engages the torque plate when the cutter assembly is in position against the shoulder of the stem. Drive pins extend between the torque plate and flange plate to transfer the torque load between the stem and cutter assembly. Bolts clamp the flange plate to the torque plate to lock the cutter assembly in position.

DESCRIPTION OF THE DRAWINGS

For a more complete understanding of the invention reference should be made to the accompanying drawings, wherein.

DETAILED DESCRIPTION

Figure 1:
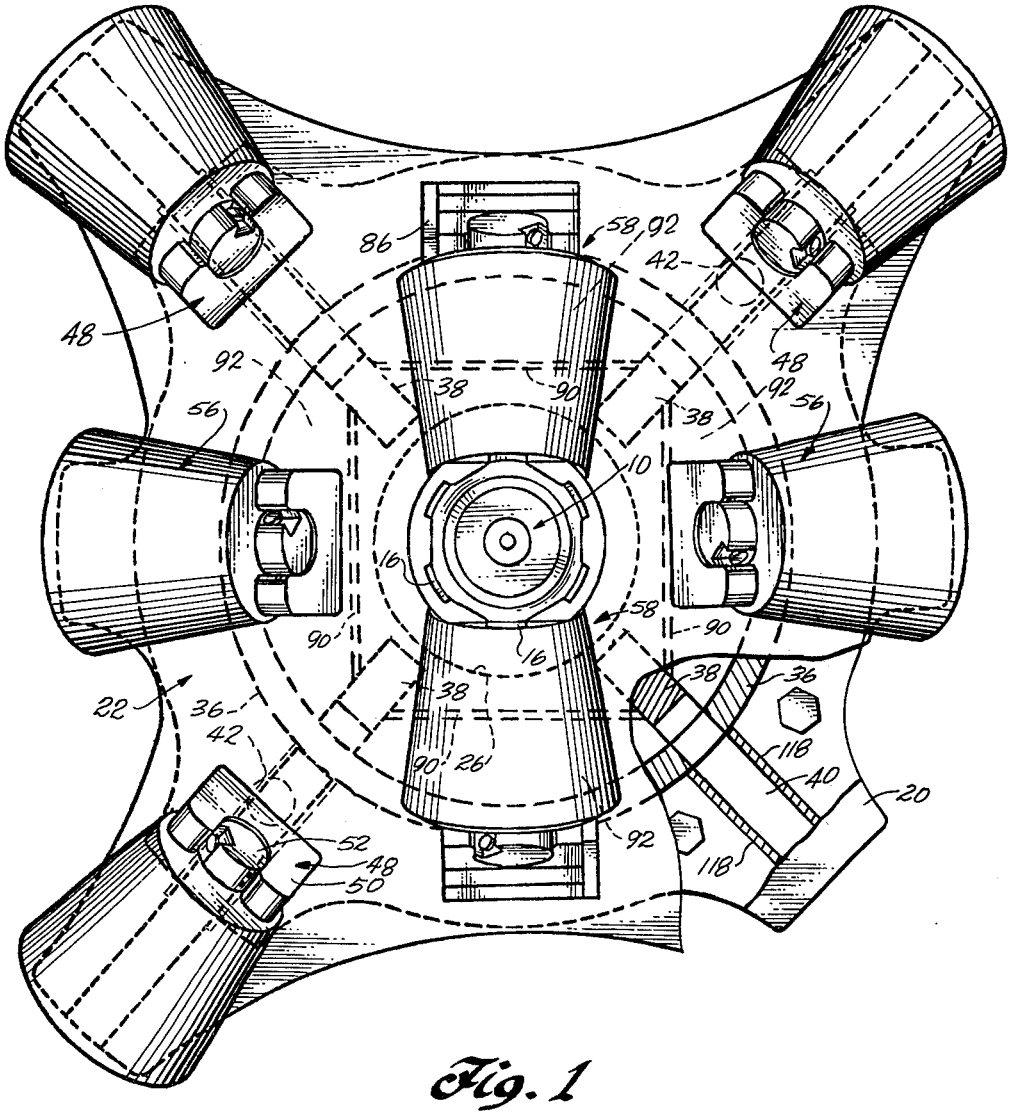
FIG. 1 is a plan view of the raise drill.

Referring to the drawings in detail, the numeral 10 indicates generally the drive shaft or stem of the raise drill. The upper end of the stem is provided with a tapered thread 12 by which it can be threaded into a standard drill string through which the raise drill is driven. The stem includes a fluted portion 14 having hard facing strips 16 welded in place to provide protection for the stem where it enters the pilot hole which is being reamed out by the raise drill.

The lower end of the stem, as indicated at 18, is welded or otherwise rigidly attached to a transverse torque plate 20. The torque plate 20 transfers torque from the stem 10 to a detachable rotary drill bit assembly, indicated generally at 22. The rotary drill bit assembly, as hereinafter described in detail, fits down over the upper end of the stem 10 and is bolted to the torque plate 20. The stem 10, together with the torque plate 20, can be replaced as a unit by detaching the torque plate 20 from the assembly 22 and withdrawing the stem.

The drill bit assembly 22 includes a main frame plate 24 having a central opening 26 which has a diameter only slightly larger than the central shank portion 28 of the stem 10. The central shank portion 28 is of a smaller diameter than the lower end 18 of the stem 10, forming an upwardly facing peripheral shoulder 30 against which the margin of the hole 26 in the main frame plate 24 fits when the assembly 22 is in the assembled position with the stem 10.

The frame plate 24 is part of a frame assembly which includes a flange plate 32 in the form of a ring having a central opening 34 which is slightly larger in diameter than the lower end 18 of the stem 10. The flange plate 32 is rigidly secured in parallel relation to the main frame plate 24 by a cylindrical collar 36 which is concentric with the openings 26 and 34. The plates 24 and 32 are also joined by four radial plates, each of which include an inner section 38 positioned on the inside of the collar 36, and an outer section 40 positioned on the outside of the collar 36. The collar 36 and inner and outer radial plate sections 38 and 40 are welded to the frame plate 24 and flange plate 32 to form a unitary frame structure for the assembly 22.

The spacing between the parallel plates 24 and 32 is such that when the frame plate 24 engages the shoulder 30 the flange plate 32 is in close proximity to the torque plate 20. Torque is transferred from the torque plate 20 to the adjacent flange plate 32 by a pair of drive pins 42. The pins 42 are anchored in the torque plate 20 and engage mating holes in the flange plate 32 for locking the two plates against relative rotation. A plurality of bolts 44 extend through aligned holes in the plates 24 and 32 and are held in place by nuts 46. When the nuts are tightened on the bolts, the bottom section 18 of the stem 10 is clamped securely between the frame plate 24 and the torque plate 20. By this arrangement, most of the axial load is transferred from the cutter assembly 22 to the stem 10 through the shoulder 30, while the torque load is transferred through the pins 42. No torque load is transmitted by the shoulder and little if any axial load is transmitted by the torque plate.

Figure 2:
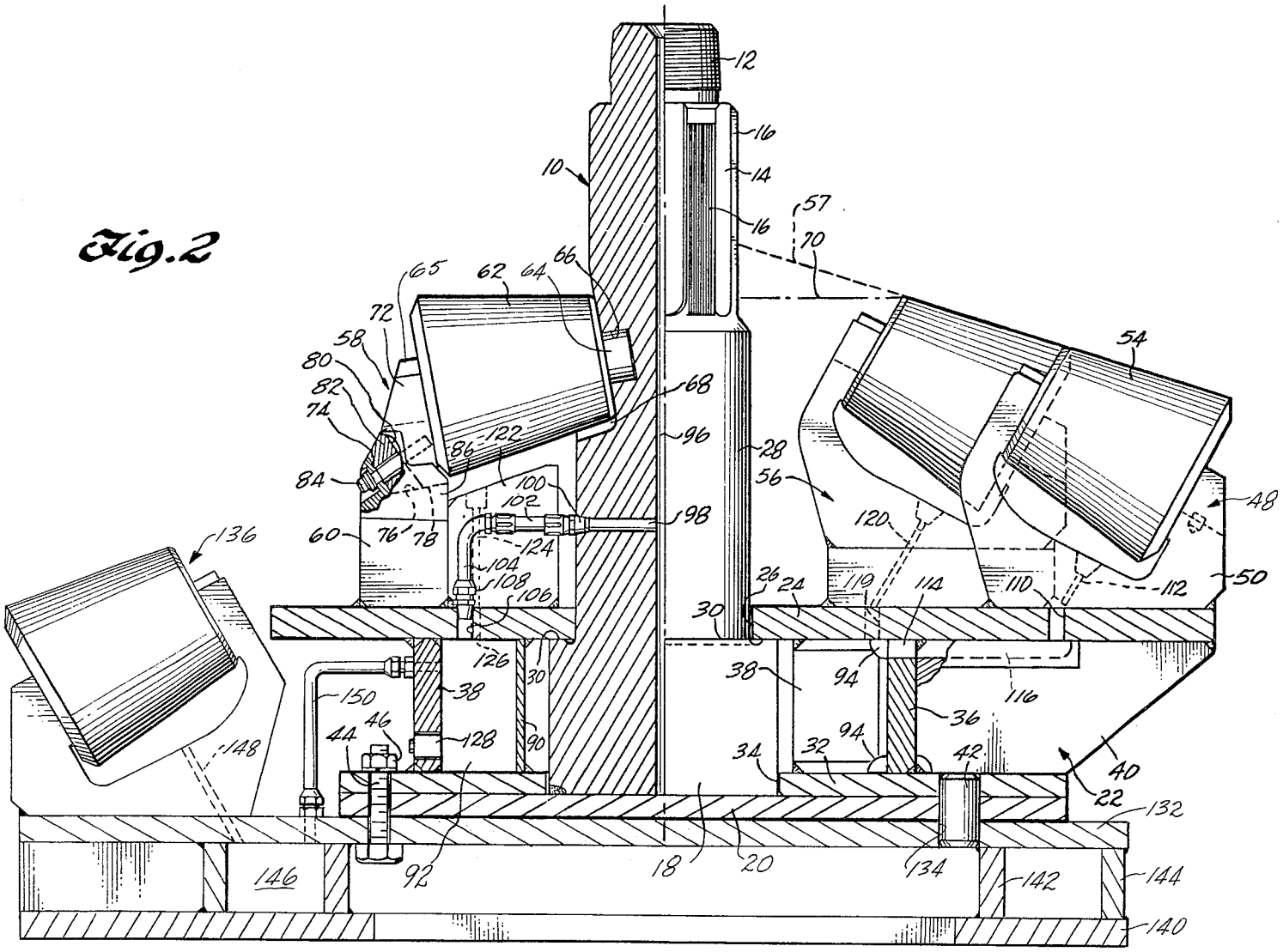
FIG. 2 is an elevational view partially in section with the cutters projected in the same plane and with a lower stage added.

Four outer rotary cutter units 48 are mounted on the main frame plate 24. Each cutter unit includes a mounting yoke 50 which supports a shaft 52 on which is journaled a conical shaped rock cutter 54. While the cutters 54 are illustrated for clarity as smooth truncated cones, it will be recognized by one skilled in the art that such cutters have a plurality of hardened steel or tungsten carbide teeth for pulverizing rock. Two similar intermediate cutter units are also mounted on the main frame plate 24 at a smaller distance from the axis of rotation of the stem, as indicated at 56. As seen in FIG. 2, the conical cutters of the outer units 48 and intermediate units 56 lie tangent to a common conical surface 57 whose axis of rotation corresponds to the axis of the stem 10.

In addition, two inner cutter units, indicated generally at 58, are supported on mounting blocks 60 welded to the main frame plate 24. The conical rotary cutter 62 is journaled on a conventional fixed bearing shaft 64, one end of which is mounted in a bore 66 in the stem 10. The stem 10 includes a recess 68 for providing clearance for the inner end of the conical cutter 62. The shaft 64 and bore 66 extend at an angle such that the cutting surfaces of the inner cutters 62 are tangent to a plane 70 which is perpendicular to the axis of the stem. The outer end of the shaft 64 is joined to a mounting yoke 72 which is removably secured to the mounting block 60 in a manner to permit the shaft 64 to be inserted into the bore 66. To this end, the top of the mounting block 60 is formed with a first flat surface 74 which intersects a second flat surface 76 in a plane parallel to the rotational axis of the conical cutter 62. The surface 74 acts as a stop. The yoke 72 has a mating surface 78 which is slidable along the surface 76. The yoke 72 also has a flat surface 80 which is parallel to the stop surface 74.

To insert the cutter 62 into operating position, the yoke 72 is lowered onto the surface 76 with the surface 80 in contact with the stop surface 74 of the mounting block 60. The inner end of the shaft 64 lies outside the bore 66 when the yoke 72 is in this position. The cutter 62 is then moved axially to slide the shaft 64 into the bore 66 by sliding the surface 78 of the yoke 72 inwardly along the surface 76. With the shaft 64 fully inserted in the bore 66, a shim or spacer 82 is inserted between the surfaces 74 and 80. The yoke 72 is then anchored in position by a pair of bolts 84 that extend perpendicular to the surfaces 74 and 80 through aligned holes in the block 60 and shim 82, the inner ends of the bolt threadedly engaging the yoke 72.

The angle of the bolts 84 is in a direction to pull downwardly and outwardly on the yoke 72, thereby securely clamping the yoke 72 against the inclined surface 76, while at the same time clamping the shim 82 securely in place. The machining tolerances are such that in pulling downwardly on the yoke 72, the tightening of the bolts 84 tends to cock the shaft 64 slightly in the bore 66, thus removing any play that might exist between the shaft 64 and the bore 66 that could otherwise be a source of wear. The block 60 is provided with a plate 86 which is welded to the block 60 and acts as a lateral stop for absorbing any lateral load between the cutter 62 and the block 60 resulting from rotation of the stem 10.

Four relatively thin, flat rectangular plates 90 are welded inside the collar 36 between the main frame plate 24 and flange plate 32 to provide a manifold for a coolant, such as water, for the rotary cutters. The plates 90 terminate at the inner radial plate sections 38, the plates 90 forming one wall for four enclosed chambers 92. The fluid communication between the chambers is provided by notching the corners of the inner radial plate sections 38, as indicated at 94. Fluid is admitted to the interconnected chambers 92 by means of a central passage 96 along the axis of the stem 10. A radial passage 98 receives a fitting 100 on the outside of the stem 10 to which a hose or other flexible fluid coupling 102 is attached. The flexible coupling 102 connects to a tube section 104 which in turn is connected to a passage 106 through the frame plate 24 by a fitting 108. The passage 106 opens into the chamber 92. Thus a coolant fluid can be pumped through the center of the drill stem into the passage 96 and radial passage 98 and through the fluid coupling into the passage 106 for filling the fluid chambers 92.

Outlet passages 110 through the frame plate 24 intersect with spray passages 112 in the yokes 50, the spray passages directing the fluid in a spray out against the surface of the associated rotary cutters 54. The cooling fluid passes from the chambers 92 to the passages 110 through openings 114 in the collar 36 through a passage formed by a recess 116 in the edge of the outer radial section 40. Cover plates 118 are welded or otherwise affixed to cover the recess 116 to provide a fluid-tight passage.

Similarly, an outlet passage 119 through the frame plate 24 communicates with a passage 120 through the supporting yokes of the intermediate cutter units 56 to provide a coolant spray for these cutters.

The inner cutters 62 are provided with an associated spray unit 122 having a passage 124 which communicates with the chamber 92 through a passage 126. A removable plug 128 in the collar 36 may be provided for draining the chamber 92.

From the above description it will be recognized that a raise drill is provided in which the stem can be readily replaced with standard wrenches, thus eliminating the need for any special cutting or welding equipment. Disassembly requires only that the bolts 84 be removed, the shims 82 removed, and the shaft 64 withdrawn from the bore 66 in the stem. After the inner cutters 58 are lifted out, the fluid coupling between the stem and chambers 92 can be disconnected, and the nuts 46 and bolts 44 removed. The stem 10 and torque plate 20 can then be separated from the drill cutter assembly 22 by sliding the stem out through the openings 26 and 34.

It will be seen that the axial load is transferred through the shoulder 30 and the torque plate 20. The torque is transferred primarily through the drive pins and partly by the journal shaft 64 for the inner cutters which connects at its ends to the stem and the mounting blocks on the frame. A minor amount of axial load is also carried by the journal shaft 64. No torque load is transmitted by the shoulder. Under ordinary circumstances, no axial load is carried by the torque plate. The stem is rigid relative to the cutter assembly so that the journal shaft 64 on the inboard cutters is secured in the bores 66 in the stem.

In some cases it is desired to raise drill or ream a hole larger than readily accommodated with a single frame assembly supporting cutters as hereinabove described. A second, larger diameter frame assembly 130, called a lower stage, can be bolted on the bottom of the above described assembly for reaming larger holes. The lower stage assembly 130 includes a plate 132 that is bolted to the bottom of torque plate 20 by means of the bolts 44. The pins 42 are also made long enough to project beyond the torque plate 20 and engage holes 134 in the plate 132. A plurality of cutter assemblies, one of which is indicated at 136, are mounted at circumferentially spaced positions on the plate 132 and are radially outboard of the cutters 48. A ring 140 is secured to the bottom of the plate 132 by a pair of concentric collars 142 and 144 which are welded in place. An annular chamber 146 between the collars provides a cooling fluid conduit for directing fluid out through bores 148 associated with each cutter assembly 136. Fluid is coupled from the chamber 92 to the chamber 146 by a suitable fluid coupling 150. Axial load to the lower frame assembly is carried by the bolts 44 back to the shoulder 30. The torque plate on the end of the stem is sandwiched between the smaller upper frame and the larger lower frame.

It will be noted that although described in relation to a raise drill pulled by a drill string through a pilot hole, principles of this invention may also be applicable to a large reaming drill pushed behind a pilot drill.

What is claimed is:

1. A raise drill comprising:

a drive stem having coupling means at the top end of the stem for connection to a drill string;

a torque plate secured to the bottom end of the stem;

an upwardly facing shoulder on the stem intermediate its ends above the torque plate;

a cutter assembly including a frame plate having a central hole therein of diameter larger than said one end of the shaft but smaller than the shoulder, whereby the frame plate can fit on the end of the shaft and against the shoulder for transmitting only axial loads therebetween, and a plurality of mounting yokes mounted on the frame plate around the central hole each mounting yoke supporting a shaft and rotary cutter journaled on the shaft; and detachable means securing the frame plate to the torque plate for transmitting torque from the stem through the torque plate to the cutter assembly.

2. Apparatus of claim 1 wherein said detachable means includes means urging the frame plate toward said bottom end of the stem and against the shoulder.

3. Apparatus of claim 2 wherein said detachable means includes a plurality of bolts extending parallel to the longitudinal axis of the stem.

4. A raise drill comprising:

a drive stem having coupling means at the top end of the stem;

a torque plate secured to the bottom end of the stem, the stem having an upwardly facing shoulder intermediate the ends of the stem;

a cutter assembly including a frame plate having a central hole therein of diameter larger than said one end of the shaft but smaller than the shoulder, whereby the frame plate can fit on the end of the shaft and against the shoulder for transmitting only axial loads therebetween, and a plurality of rotary cutters mounted on the frame plate around the central hole;

a flange plate extending parallel to the frame plate, the flange plate having a hole coaxial with the hole in the frame plate but larger in diameter than the outer edge of the shoulder to permit the flange plate to fit down over the shoulder and into position adjacent the torque plate; and means securing the flange plate and torque plate together for transmitting torque from the torque plate to the cutter assembly.

5. Apparatus of claim 4 wherein the cutters are mounted on the opposite side of the frame plate from the flange plate.

6. Apparatus of claim 5 further including means forming a closed chamber between the frame plate and the torque plate, the stem having a longitudinal fluid passage extending from said one end of the stem and a radial passage extending from the longitudinal passage to the outside of the stem, and a flexible fluid coupling means connecting the outer end of the radial passage to the interior of said chamber.

7. A raise drill having a stem readily replaceable in the field comprising:

a stem having means at its upper end for connection to a drill string for transmitting tension and torque;

a first, relatively smaller diameter portion nearer the upper end of the stem;

a second, relatively larger diameter portion nearer the lower end of the stem;

an upwardly facing peripheral shoulder on the stem between the first and second portions;

a torque transmitting plate secured on the bottom of the stem;

a main frame comprising an upper plate having a central hole slightly larger than the diameter of the first portion of the stem and appreciably smaller than the second portion of the stem for resting on the peripheral shoulder and carrying only a compressive load therebetween, means for mounting a plurality of rock cutter cones on the top of the upper plate, a torque transmitting ring welded on the bottom of the upper plate, and a torque transmitting plate welded on the bottom of the ring; and means for bolting the torque transmitting plate on the stem against the torque transmitting plate on the main frame.

8. Apparatus of claim 7 further including torque pins extending between the torque plate on the stem and the main frame for transmitting torque from the torque plate on the stem to the main frame.

9. A raise drill comprising: a drive stem having a shoulder intermediate the ends of the stem and connector means for transmitting axial load and torque at one end, a rotary cutter assembly comprising a flat sided frame and plurality of rotatable cutter cones mounted thereon, said frame having a central opening for slidably receiving the stem, the margin of the opening engaging the shoulder on the stem for carrying axial load therebetween, means at the end of the stem opposite from the connector means for detachably securing the assembly to the stem in torque transferring relationship, said means including a flat sided torque plate rigidly attached to the end of the stem, and clamping means extending between and detachably connected to the torque plate and the cutter assembly to urge the flat side of the frame towards the flat side of the torque plate and urge the margin of the opening against the shoulder.

10. A raise drill comprising:

a drive stem having coupling means at the top end of the stem;

a torque plate secured to the bottom end of the stem, the stem having an upwardly facing shoulder intermediate the ends of the stem;

a cutter assembly including a frame plate having a central hole therein of diameter larger than said one end of the shaft but smaller than the shoulder, whereby the frame plate can fit on the end of the shaft and against the shoulder for transmitting only axial loads therebetween, and a plurality of rotary cutters mounted on the frame plate around the central hole;

detachable means for connecting the cutter assembly to the torque plate for transmitting torque therebetween; and a lower cutter stage assembly releasably secured to the bottom of the torque plate, the lower stage having a plurality of rotating cutters radially positioned beyond the periphery of the frame plate.

11. Apparatus of claim 10 wherein the detachable means further includes a flange plate extending parallel to the frame plate, the flange plate having a hole coaxial with the hole in the frame plate but larger in diameter than the outer edge of the shoulder to permit the flange plate to fit down over the shoulder and into position adjacent the torque plate, and bolts securing the flange plate and torque plate together.

12. Apparatus of claim 11 wherein the cutters on the frame plate are mounted on the opposite side of the frame plate from the flange plate.

13. Apparatus of claim 12 further including means forming a closed chamber between the frame plate and the flange plate, the stem having a longitudinal fluid passage extending from said one end of the stem and a radial passage extending from the longitudinal passage to the outside of the stem, and a flexible fluid coupling means connecting the outer end of the radial passage to the interior of said chamber.

14. Apparatus of claim 13 wherein the lower stage assembly includes means forming a fluid-tight chamber, means directing fluid from said chamber to the cutters on the lower stage, and means forming a fluid passage coupling said chamber to the chamber between the frame plate and the flange plate.

15. A replaceable stem for a raise drill comprising a stem having an enlarged diameter at one end forming a shoulder for transmitting only axial loads, a flat plate attached to the enlarged diameter end, the plate extending radially beyond the perimeter of the stem and including means for accommodating torque transmitting pins, the stem having a plurality of counterbores extending into the stem, the bores being spaced axially from the shoulder in a direction away from the plate end of the stem, and means at the opposite end of the stem from the plate for detachably coupling the stem to the end of an axially aligned shaft.

16. Apparatus of claim 15 wherein the stem includes a fluid passage extending through the stem in an axial direction.

17. A raise drill having a stem readily replaceable in the field comprising:

a stem comprising connection means at the upper end of the stem for transmitting axial load and torque, a first, relatively smaller diameter portion nearer the upper end of the stem, a second, relatively larger diameter portion nearer the lower end of the stem, an upwardly facing peripheral shoulder on the stem between the first and second portions for transmitting axial load, and a torque transmitting plate secured on the bottom of the stem;

a main frame comprising an upper plate having a central hole slightly larger than the diameter of the first portion of the stem and appreciably smaller than the second portion of the stem for resting on the peripheral shoulder and carrying only a compressive load therebetween, means for mounting a plurality of rotatable rock cutter cones on the top of the upper plate, a lower torque transmitting plate, and means for transmitting torque between the lower plate and the upper plate; and means for connecting the lower torque transmitting plate on the stem to the torque transmitting plate on the main frame for transmitting torque therebetween.

18. Apparatus of claim 17 wherein the means for connecting comprises a plurality of torque pins extending between the torque plate and the lower torque plate on the main frame for transmitting torque therebetween and means for bolting the torque plate on the stem and the lower torque plate together.

* * * * *